United States Patent [19]

Morgan, Jr.

[11] 4,040,364

[45] Aug. 9, 1977

[54] TABLE APPARATUS INCLUDING A LOCKABLE, ROTATABLE TRAY

[76] Inventor: A. Perry Morgan, Jr., Constitution Hill, Princeton, N.J. 08540

[21] Appl. No.: 671,207

[22] Filed: Mar. 29, 1976

[51] Int. Cl.[2] ..... A47B 11/00

[52] U.S. Cl. ..... 108/28; 108/104; 108/142

[58] Field of Search ..... 108/28, 104, 103, 142, 108/151, 23; 248/425; 431/295

[56] References Cited

U.S. PATENT DOCUMENTS

| | | | |
|---|---|---|---|
| 1,053,742 | 2/1913 | Osvald | 108/104 |
| 1,534,848 | 4/1925 | Galgoczi | 108/142 |
| 1,653,296 | 12/1927 | Kremenek | 108/142 X |
| 1,935,831 | 11/1933 | Cunningham | 431/295 X |
| 2,317,042 | 4/1943 | Evans | 108/104 |
| 2,453,443 | 11/1948 | Logan | 108/104 X |
| 2,495,250 | 1/1950 | Gilly | 108/104 X |

*Primary Examiner*—Roy D. Frazier

*Assistant Examiner*—Darrell Marquette

*Attorney, Agent, or Firm*—Behr & Woodbridge

[57] ABSTRACT

A rotatable tray fits in the circular, central depression of a tabletop. The periphery of the tray includes four semicircular cutout sections which respectively align with four semicircular cutout sections on the edge of the depression to form locking apertures. Four candleholders are adapted to be received in the locking apertures thus formed. When the table is used for formal occasions, the candleholders are placed in the locking apertures, giving the table a formal appearance. For informal occasions, the locking candleholders are removed and the tray is rendered rotatable. The candelholders have a cylindrical lower locking section and an upper cylindrical sidewall section adapted to transmit the light of the candle therethrough.The table also includes a base support including four upright legs attached at one end to the tabletop and at the other end to an X-shaped foot section.

11 Claims, 8 Drawing Figures

TABLE APPARATUS INCLUDING A LOCKABLE, ROTATABLE TRAY

CROSS REFERENCE TO RELATED APPLICATIONS

Refer to my co-pending design application entitled "TABLE" filed on even date.

BACKGROUND OF THE INVENTION

1. Field of the Invention

This invention relates to a table apparatus including a lockable, rotatable tray.

2. Description of the Prior Art

There are several different types of revolving tray and table combinations known in the prior art. OWENS, U.S. Pat. No. 1,669,671, EVANS, U.S. Pat. No. 2,317,042 and BARTSCHY, U.S. Pat. No. 2,570,634 all disclose tables having a revolving tray wherein the surface on the tray is flush with the surface of the table.

Prior art tables having an elevated rotatable centerpiece are disclosed in LOGAN, U.S. Pat. No. 2,453,443 and LOVATO, U.S. Pat. No. 1,584,621. U.S. Pat. No. Des. 221,444 to LUKENS is relevant to the extent that it discloses a circular but apparently hollow center table section and an X-shaped leg base support.

The LOGAN patent discloses a feature wherein the tray may be selectively removed from a rotatable lower member. The tray includes locking holes which mate and lock with a plurality of pegs situated around the periphery of the rotatable member. EVANS is of interest also in that it appears to disclose a mechanism in FIG. 5 thereof for rotating a tray by means of a lever.

While the foregoing all appear to disclose prior art tables having revolvable center sections they nevertheless do not to disclose apparatus in which the center section may be selectively locked relative to the non-rotatable portion of the table. More particularly, the prior art does not appear to disclose the use of candleholders of the type disclosed herein for the purpose of locking a rotatable tray relative to the rest of the table.

SUMMARY OF THE INVENTION

Briefly described, the invention comprises a table having a rotatable tray as a centerpiece. The surface of the tray lies in the same plane as the surface of the table and includes four arcuate, semicircular cutouts spaced at 90° intervals around the periphery thereof. The tray fits in a circular depression in the center of the table. The periphery of the circular depression includes four semicircular cutout sections which are adapted to line up across from the four cutout sections in the revolvable tray. When the four cutout sections of the tray are aligned across from the respective four cutout sections in the periphery of the depression, a set of four circular locking apertures is created therebetween. The locking apertures are adapted to receive candleholders. When candleholders are placed in the locking apertures, the revolvable centerpiece is then locked relative to the surface of the table. In this mode, the table is adapted for use on formal occasions. When the candleholders are removed, the tray is unlocked relative to the rest of the table and may be used for informal occasions.

The candleholders include a cylindrical lower section which fits into the locking aperture and a cylindrical upper section which allows the candlelight to shine therethrough. The lower upper section is connected via a circular base section having vent holes therein for the upper section.

The table just described includes functional and ornamental features not found in the prior art. These and other features of the present invention will be more fully appreciated with reference to the following drawings.

DETAILED DESCRIPTION OF THE INVENTION

During the course of this description, like numbers will be used to illustrate like elements according to the various different views of the invention.

Figure 1:
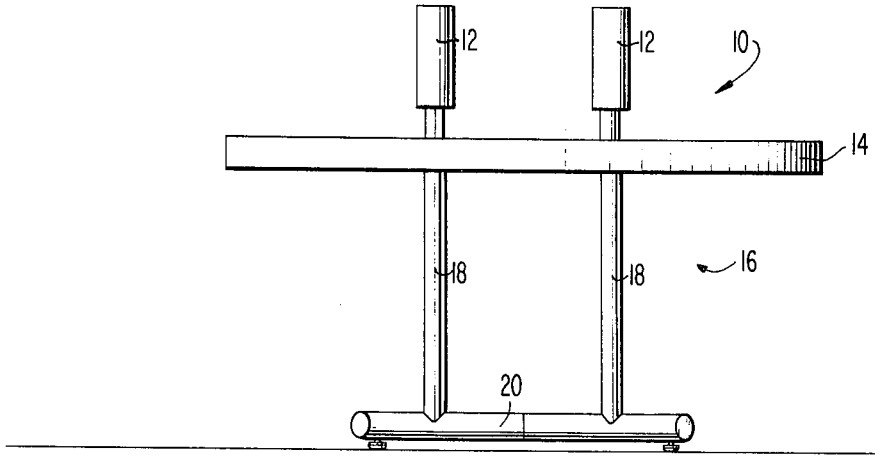
FIG. 1 is a side elevational view of the invention according to the preferred embodiment with the candleholders in the locking position for a formal occasion.

The table of the present invention as set up for a formal occasion is illustrated in FIG. 1. The table 10 includes a plurality of candleholders 12, a flat tabletop 14 and a base support means 16 including four upstanding legs 18 and an X-shaped foot section 20. According to the embodiment of FIG. 1, the candleholders 12 in their locking position. In this fashion, the rotatable tray 22 is locked relative to the flat tabletop 14 in a manner that will be described subsequently in more detail.

Figure 2:
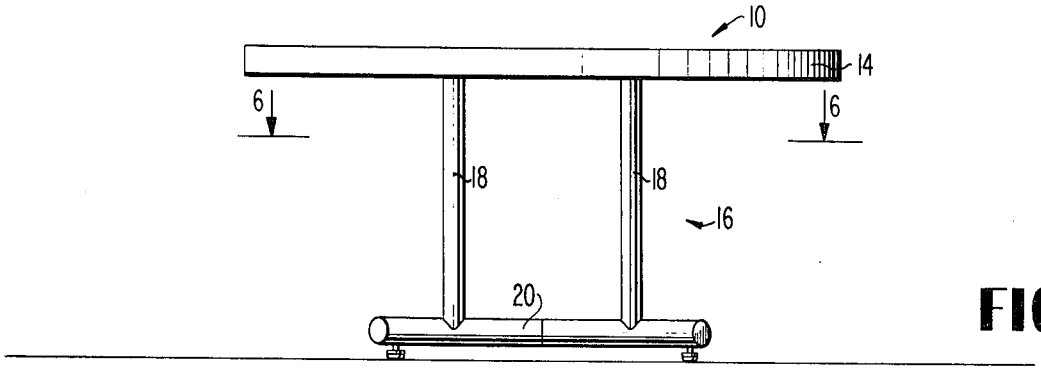
FIG. 2 is a side elevational view of the present invention with the candleholders removed for informal occasions.

In FIG. 2, the table 10 is set up for informal occasions. In this mode, the candleholder stops 12 have been removed, thereby unlocking tray 22 relative to the tabletop 14. A typical informal occasion might include a family breakfast or lunch where it is desirable to have a rotatable tray for the transportation of jams, jellies, condiments, etc. In the formal mode as illustrated in FIG. 1, the table might be used for entertaining dinner guests. On such an occasion, the candleholders 12 serve the dual function of locking the tray and providing candlelight to enhance the formal atmosphere of the event. In the informal and formal modes, the invention 10 has significant ornamental and functional features.

Figure 3:
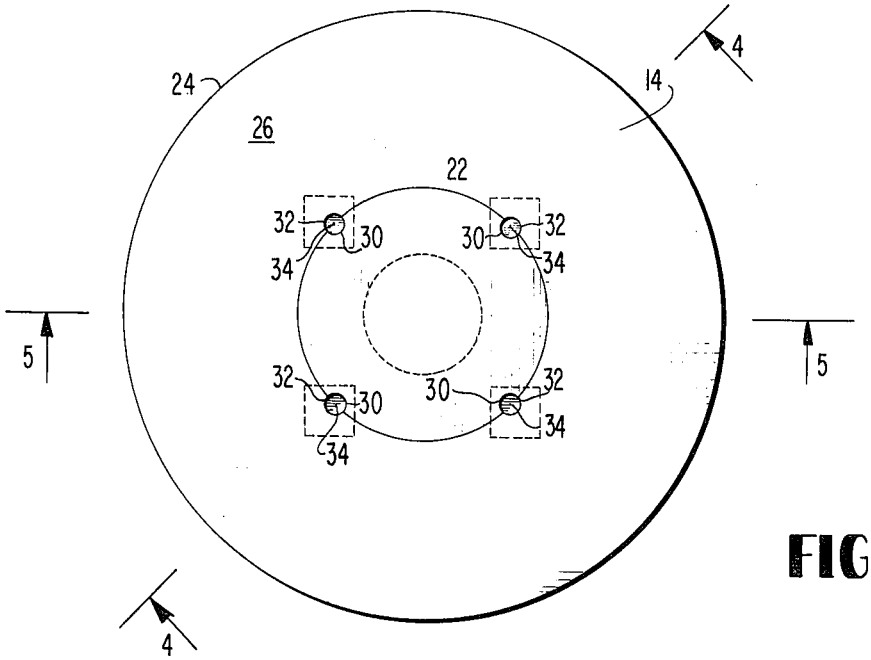
FIG. 3 is a top plan view of the table illustrated in FIG. 2.

FIG. 3 illustrates the relationship between tray 22 and the tabletop 14. The surfaces of the tray 22 and the tabletop 14 are preferably flat and aligned so as to lie flush in the same plane. The tabletop 14 includes a continuous edge or rim 24 and a flat working surface 26. According to the preferred embodiment, the rim 24 might comprise an attractive, continuous teakwood trim. In order to enhance durability and wear, the surface 26 preferably comprises a tough, hard plastic material.

Tray 22 fits in a depression 28 in the center of tabletop 14 in such a fashion that the surface of the tray 22 is flush and in the same plane as the surface 26 of the tabletop 14. This feature will be explained in more detail with respect to FIG. 4. In order to enhance the attractiveness of table 10, the surface of tray 22 preferably comprises a material which contrasts with the material of the surface 26. According to the preferred embodiment, the tray 22 comprises a teakwood finish similar to the material incorporated in the rim section 24 of the tabletop 14. The teakwood finish of the tray 22 and the rim section 24 provides a pleasing contrast with the white plastic finish of the surface 26.

Tray 22 also includes on its periphery four semicircular cutout sections 30. The four cutout sections 30 are distributed evenly around the periphery of tray 22 at 90° intervals from one another. In a similar manner, the circular depression 28 includes four corresponding semicircular cutouts 32 located at 90° intervals with respect to one another. Cutouts 30 and 32 are positioned so that when aligned across from each other they form four circular locking apertures 34. Locking apertures 34 are adapted to receive the lower cylindrical section 48 of the candleholders 12. When the candleholders 12 are in the positions as shown in FIG. 1, the tray 22 is locked relative to tabletop 14. When the candleholders 12 are removed, the tray 22 is then free to rotate in a conventional manner.

Figure 4:
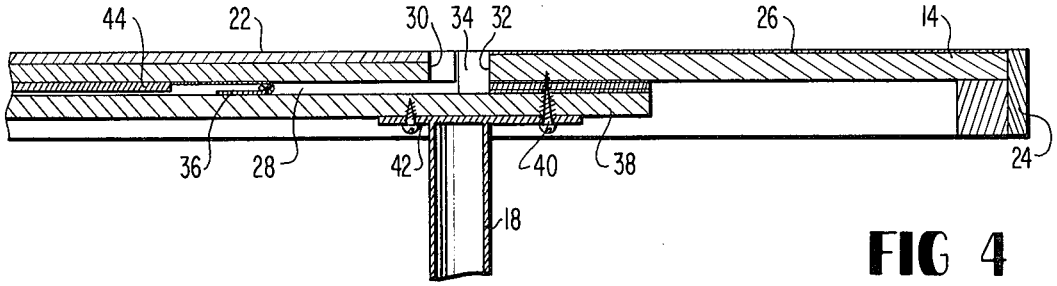
FIG. 4 is a cross-sectional view of the table illustrated in FIG. 3 as seen from perspective 4—4.

FIG. 4 is a cross section of the table as seen in FIG. 3 according to perspective 4—4. In this figure, the locking aperture 34 is also shown in cross section. The diameter of aperture 34 is preferably only slightly larger than the diameter of lower cylindrical section 48 of the candleholder 12. The fit should be sufficiently loose so as to facilitate the easy removal of the candleholder but sufficiently tight so as to prevent unnecessary wobble. Tray 22 is received in depression 28 such that its flat surface is in the same plane as surface 26 of tabletop 14. The central interior of depression 28 includes an axially aligned metal turntable 36 which is permanently attached to a baseboard 38. The baseboard 38 is attached by means of wood screws 40 to tabletop 14. Screws 40 also pass through a leg plate 42 and thereby securely fasten the upstanding leg sections 18 of the base support 16 to the tabletop 14. The underside of the tray 22 is equipped with a permanent disc 44 which is adapted to be received in the center of the turntable 36. Disc 44 aids in aligning the turntable relative to the depression 28.

One important feature of the present invention is the fact that the tray 22 may be easily removed from the depression 28 by grasping cutout sections 30 and lifting the tray 22 upward and away from the depression 28. In this manner the tray 22 may be easily cleaned, both on top and underneath and crumbs, etc. may be removed from depression 28.

Figure 5:
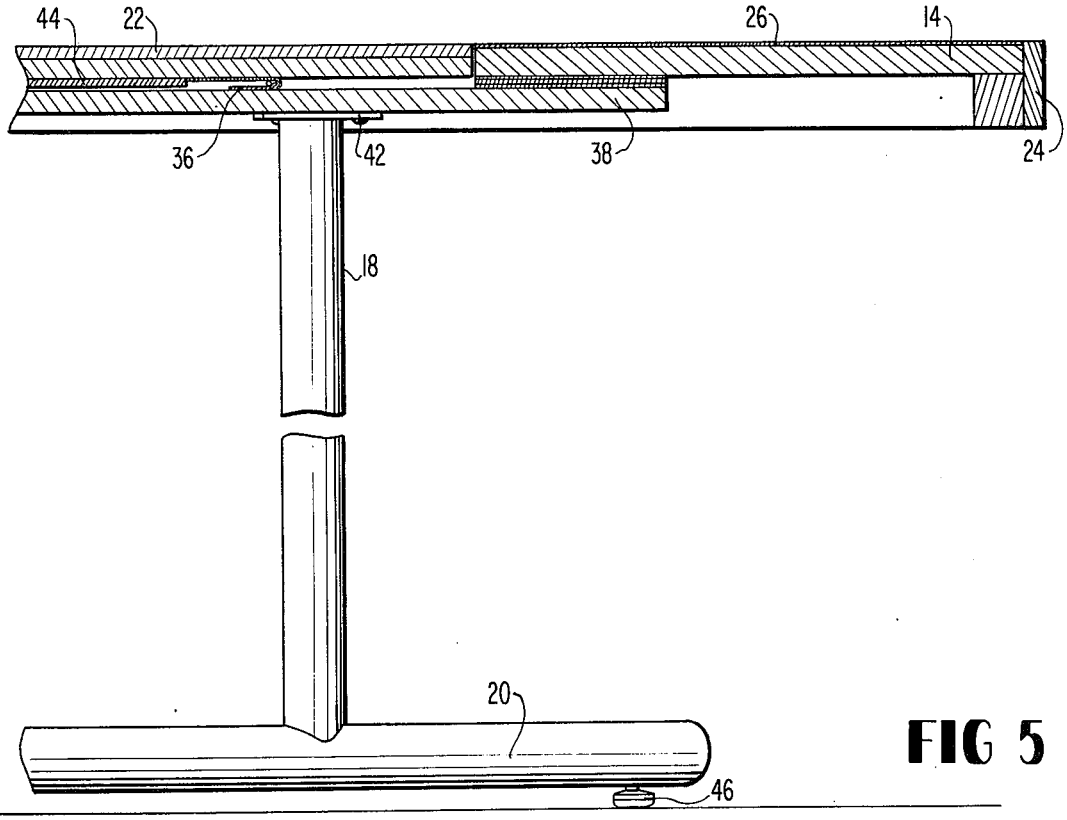
FIG. 5 is a cross-sectional view of the table illustrated in FIG. 3 as seen from the perspective 5—5.
Figure 6:
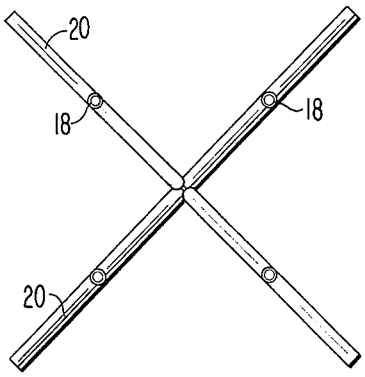
FIG. 6 is a cross-sectional view of the base section of the table as illustrated in FIG. 2 and seen from perspective 6—6.

FIG. 5 is a cross-sectional view of the table of FIG. 3 as seen from perspective 5—5. According to that view of the present invention, it will be noted that there is only a very small clearance between the periphery of tray 22 and the periphery of depression 28. As discussed previously, the disc 44 attached to the bottom of tray 22 helps to insure the alignment of tray 22 in depression 28. As also shown in FIG. 5, the upstanding leg sections 18 of the base support 16 terminate in an X-shaped foot section 20. The ends of the foot sections 20 are equipped with adjustable levelers 46 of the sort known to those of ordinary skill in the art. The X-shape of the foot section is shown in cross-section in FIG. 6. This particular type of preferred base support has a very stable and economic structure. However, it will be appreciated that various other types of base supports could be employed without departing from the spirit of the invention.

Figure 7:
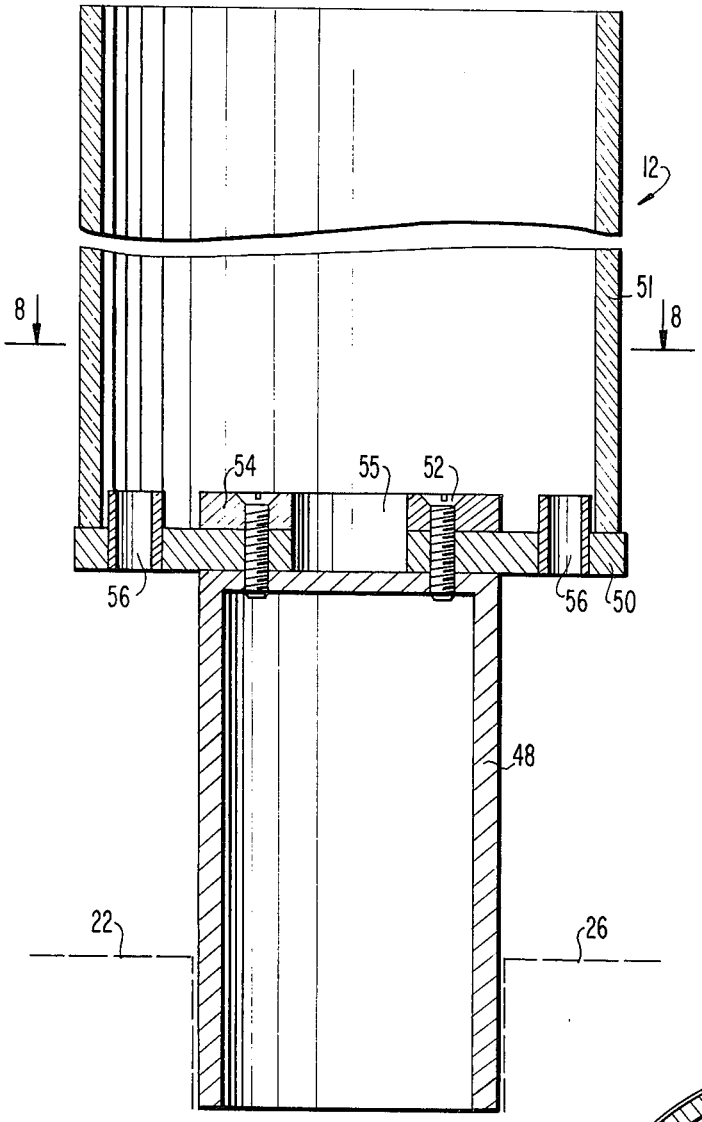
FIG. 7 is a cross-sectional view of one of the candleholders.
Figure 8:
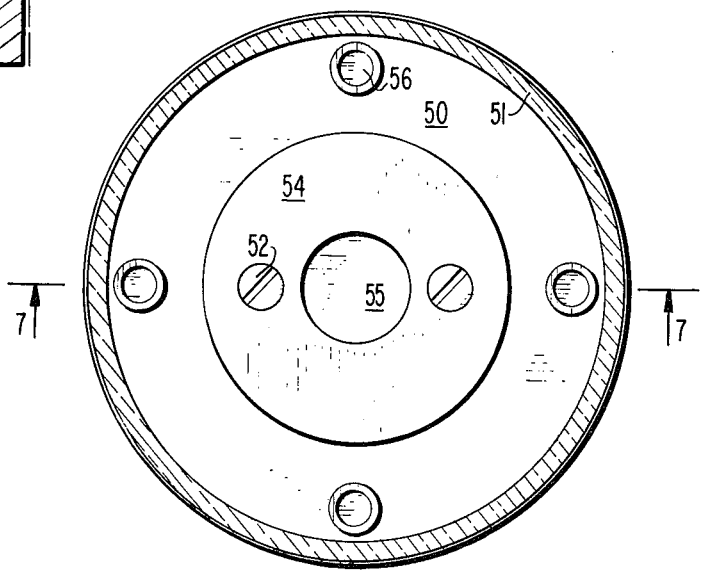
FIG. 8 is a top plan view of the base of a candleholder as seen from perspective 8—8.

A cross-sectional view of a candleholder 12 is illustrated in FIG. 7. As previously discussed, the candleholder 12 acts as a stop or locking means for preventing the rotation of tray 22 relative to tabletop 14. Candleholder 24 includes a cylindrical lower section 48, a circular base section 50 and a transparent cylindrical upper sidewall section 51. Lower section 48 is connected via machine screws 52 and disc 54 to base 50. Disc 54 and base 50 define at the center thereof a cavity 55 approximately $\frac{7}{8}$ inch in diameter which is adapted to receive a candle. The transparent sidewalls 51 comprise a glass or plastic material for transmitting the light of the candle while protecting the flame from drafts. Base plate 50 is also provided with a plurality of vent holes 56 which allow fresh air to be drawn in. The heat of the candle causes the air inside the holder 12 to rise, thereby drawing fresh air into the combusion chamber through the vent holes 56. As shown in FIG. 8, the preferred embodiment includes four vent holes 56 aligned evenly around base 50 at 90° intervals relative to one another. According to the preferred embodiment, the cylindrical lower section 48 comprises a 2 inch O.D. black metal tube of a diameter slightly smaller than the diameter of locking apertures 34. Base 50 comprises a chrome plated $\frac{1}{4}$ inch disc having a plurality of tubes located therein defining the vent passageways. Transparent sidewall section 51 preferably comprises a glass material but, of course, it could comprise suitable plastic materials also. Under certain circumstances, it may be desirable to use translucent as opposed to transparent materials in the sidewall.

The materials used in constructing the present invention are conventional and readily available. Leg section 18 and foot section 20 comprise 2 inch O.D. mechanical tubing, preferably black in color. Turntable 36 is commercially available from hardware outlets. Likewise, the wood, plastic and screw elements used in assembling the table are conventional materials available to the general public. In operation, the table may be set up for formal occasions by aligning cutout sections 30 across from cutout section 32 and placing the lower section 48 of the candleholder 12 into the locking apertures 48. The table is then suitable for formal occasions and appears as illustrated in FIG. 1. For more informal occasions, the candleholders 12 are removed and the tray 22 is thus unlocked and free to rotate.

While the invention has been particularly shown and described with reference to the preferred embodiment thereof, it will be understood by those skilled in the art that various changes in form and detail may be made therein without departing from the spirit and scope of the invention.

I claim:

1. A table apparatus comprising:

a table top having a depression therein, said depression having a periphery including a plurality of cut-out sections located there-around;

a base support means for supporting said table top;

a rotatable tray means fitted in said depression, said rotatable tray means having a periphery including a plurality of cut-out sections there-around at least some of which line up across from corresponding cut-out sections in the periphery of said depression to form locking apertures therewith; and, locking means fitted in said locking apertures for selectively locking said rotatable tray means relative to said table top.

2. The apparatus of claim 1 wherein said locking means is removable.

3. The apparatus of claim 2 wherein said locking means comprise candleholders.

4. The apparatus of claim 3 wherein said candleholders comprise:

a lower section adapted to be received in said locking apertures; and, an upper section connected to said lower section by a base which is adapted to receive a candle, said upper section further including a light transmitting sidewall section.

5. The apparatus of claim 4 wherein said cutout sections are approximately semicircular in shape.

6. The apparatus of claim 5 wherein said lower section is cylindrical in shape.

7. The apparatus of claim 6 wherein said sidewall section is cylindrical and said base is circular in shape.

8. The apparatus of claim 7 wherein said base includes vent holes therein for providing air to said candle.

9. The apparatus of claim 8 wherein base support means includes four upstanding legs attached at one end of each to said tabletop and at the other end of each to an X-shaped foot section.

10. The apparatus of claim 9 wherein said depression includes a rotatable turntable mechanism located in the center thereof.

11. The apparatus of claim 10 wherein said tray means includes a disc on the underside thereof adapted to mate with said turntable mechanism and align said tray means relative to said depression.

* * * * *